US012753349B2

(12) United States Patent
Andersen

(10) Patent No.: US 12,753,349 B2
(45) Date of Patent: Oct. 6, 2026

(54) PROCESS FOR HYDROTREATING A LIQUID OIL FEEDSTOCK

(71) Applicant: TOPSOE A/S, Kgs. Lyngby (DK)

(72) Inventor: Stefan Andersen, Værløse (DK)

(73) Assignee: TOPSOE A/S, Kgs. Lyngby (DK)

( * ) Notice: Subject to any disclaimer, the term of this patent is extended or adjusted under 35 U.S.C. 154(b) by 159 days.

(21) Appl. No.: 18/727,471

(22) PCT Filed: Dec. 20, 2022

(86) PCT No.: PCT/EP2022/086864
§ 371 (c)(1),
(2) Date: Jul. 9, 2024

(87) PCT Pub. No.: WO2023/134974
PCT Pub. Date: Jul. 20, 2023

(65) Prior Publication Data

US 2025/0084316 A1 Mar. 13, 2025

(30) Foreign Application Priority Data

Jan. 12, 2022 (EP) ..... 22151138

(51) Int. Cl.
*C10G 3/00* (2006.01)
*C10B 53/02* (2006.01)
(Continued)

(52) U.S. Cl.
CPC ..... *C10G 3/50* (2013.01); *C10B 53/02* (2013.01); *C10G 1/002* (2013.01); *C10G 3/46* (2013.01);
(Continued)

(58) Field of Classification Search
None
See application file for complete search history.

(56) References Cited

U.S. PATENT DOCUMENTS 8,283,506 B2 10/2012 Kokayeff et al.
9,315,737 B2 4/2016 Dupassieux et al.
(Continued)

FOREIGN PATENT DOCUMENTS

CN 103122254 A 5/2013
CN 104877707 A 9/2015
(Continued)

OTHER PUBLICATIONS

European Search Report dated Jun. 20, 2022 for European Application No. 22151138.9.
(Continued)

*Primary Examiner* — Ali Z Fadhel
(74) *Attorney, Agent, or Firm* — LEYDIG VOIT & MAYER, LTD.

(57) ABSTRACT

Process and plant for hydrotreating a liquid oil feedstock stream comprising the steps of i) conducting the liquid oil feedstock stream to a stabilization step by reacting the liquid oil stream with hydrogen in the presence of a catalyst for producing a stabilized composition, and separating therefrom: a stabilized stream comprising a gas phase, and a stabilized liquid oil stream; ii) providing a main hydrodeoxygenation (HDO) step, comprising: ii)-1 conducting at least a portion of said stabilized stream comprising a gas phase, or a stabilized feed stream combining at least a portion of said stabilized stream comprising a gas phase and a portion of said stabilized liquid oil stream, to a main hydrodeoxygenation (HDO) step in a first bed active in hydrodeoxygenation (HDO), thereby producing a first main hydrotreated effluent stream; ii-2) combining at least a portion of said stabilized liquid oil stream with said first main hydrotreated effl-uent stream, thereby producing a first mixed stabilized gas-liquid oil stream; ii-3) con-ducting said first mixed stabilized gas-liquid oil stream to a subsequent
(Continued)

bed active in HDO, thereby producing a main hydrotreated effluent stream.

23 Claims, 1 Drawing Sheet

(51) Int. Cl.
*C10G 1/00* (2006.01)
*C10G 65/02* (2006.01)

(52) U.S. Cl.
CPC ..... *C10G 65/02* (2013.01); *C10G 2300/1014* (2013.01); *C10G 2300/4081* (2013.01); *C10G 2400/08* (2013.01)

(56) References Cited

U.S. PATENT DOCUMENTS

| | | | | |
|---|---|---|---|---|
| 2008/0050792 | A1 | 2/2008 | Zmierczak et al. | |
| 2010/0076238 | A1 | 3/2010 | Brandvold et al. | |
| 2012/0216450 | A1* | 8/2012 | Dupassieux | B01J 23/88 44/307 |
| 2013/0012746 | A1 | 1/2013 | Luebke et al. | |
| 2014/0275666 | A1 | 9/2014 | Bauer et al. | |
| 2015/0166473 | A1 | 6/2015 | Chapus et al. | |
| 2017/0253808 | A1 | 9/2017 | Sinha et al. | |
| 2023/0014266 | A1* | 1/2023 | Myllyoja | C10G 3/47 |
| 2023/0101213 | A1* | 3/2023 | Trivedi | C10G 3/50 208/213 |

FOREIGN PATENT DOCUMENTS

| | | |
|---|---|---|
| WO | WO 2022008508 A1 | 1/2022 |
| WO | WO 2023/134973 A1 | 7/2023 |

OTHER PUBLICATIONS

International Search Report and Written Opinion mailed Apr. 14, 2023 in PCT/EP2022/086864.

* cited by examiner

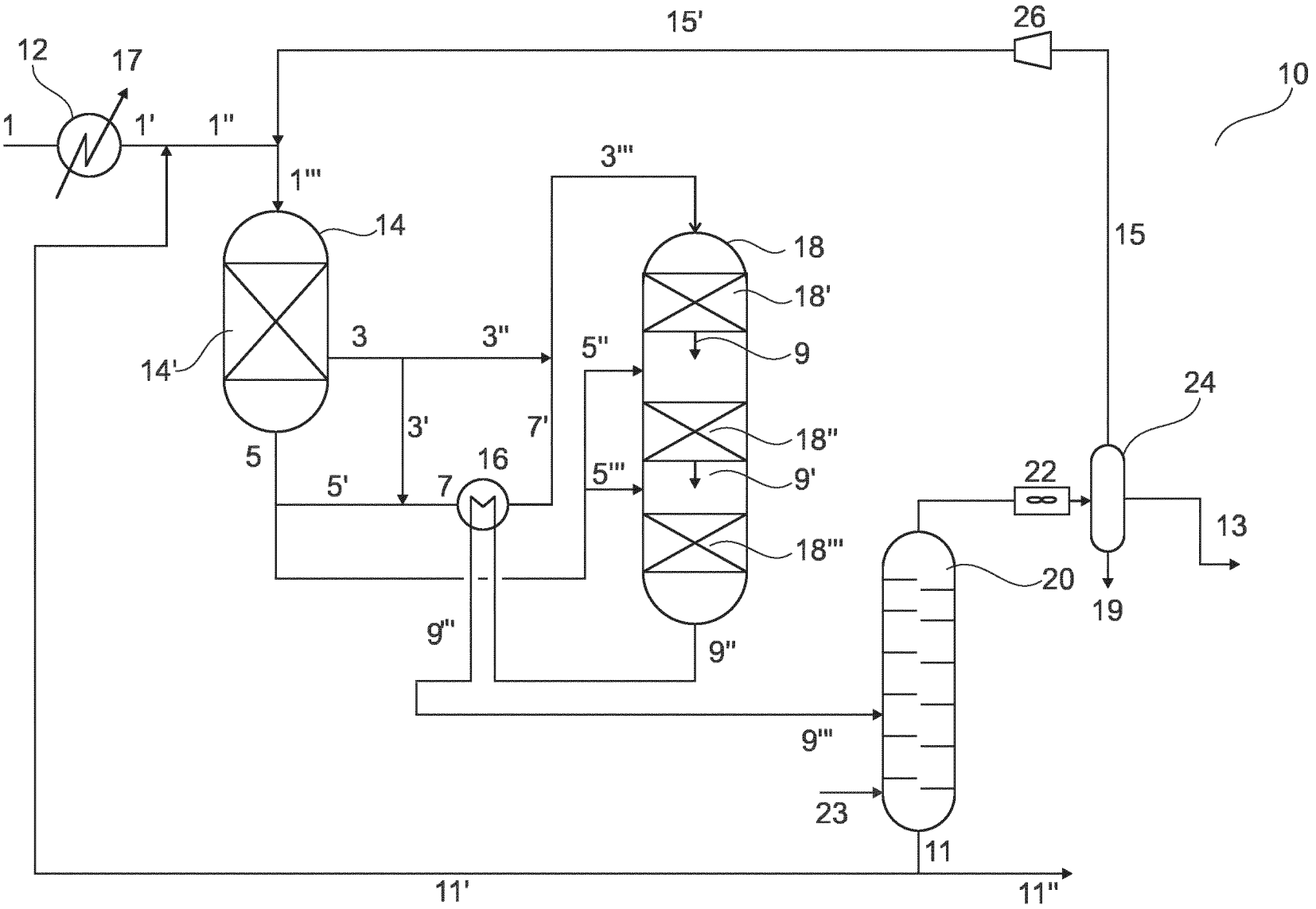
10
24
13
15
19
26
22
20
11''
11
23
9'''
18
18'
9
18''
9'
18'''
9''
15'
3'''
5''
5'''
7'
3''
16
7
9'''
11'
3'
14
3
5'
1'''
5
1''
14'
17
1'
12
1

PROCESS FOR HYDROTREATING A LIQUID OIL FEEDSTOCK

CROSS-REFERENCE TO RELATED APPLICATIONS

This application is a U.S. National Stage Application filed under 35 U.S.C. § 371 of International Application Serial No. PCT/EP2022/086864 filed Dec. 20, 2022 (WO 2023/134974 A1), which claims priority to and the benefit of European Application No. 22151138.9, filed Jan. 12, 2022, which is hereby incorporated by reference in its entirety.

The invention relates to the field of hydroprocessing of reactive liquid oils such as liquid oils produced from hydrothermal liquefaction, or from pyrolysis i.e. pyrolysis oils, more specifically to the stabilization of a liquid oil by hydrotreating prior to being upgraded by further hydrodeoxygenation (HDO).

The field of renewable feedstocks has been attracting a great deal of attention, not only in Europe, but also US and China. Using renewable feedstocks enables a sustainable approach to the production of hydrocarbon products boiling in the transportation fuel range, in particular any of diesel, jet fuel and naphtha.

A higher demand is expected for the hydroprocessing of advanced renewable feedstocks, such as pyrolysis oils derived from solid renewable feedstocks. The pyrolysis oil may have a very high oxygen content, which needs to be decreased before it can be used as liquid fuel, i.e. as hydrocarbon fuel boiling in the transportation fuel range. The oxygen is generally removed by hydroprocessing in a catalytic hydrodeoxygenation (HDO) using high pressure (100-200 bar) and high temperature (350-400° C.). In some instances, the HDO is operated at 60-80 bar and 280-330° C. However, a liquid oil such as a hydrothermal liquefaction oil (hereinafter also referred to as HTL oil) or a pyrolysis oil is very unstable and when heated it tends to polymerize, which leads to rapid catalyst deactivation and plugging of the HDO reactor, due to coking. Therefore, it is known to stabilize pyrolysis oils thereby i.a. by converting carbonyls to alcohols.

For instance, US 2014/0275666 A1 discloses a two-stage process for producing renewable fuels from a pyrolysis oil. In a first stage, organic reactive molecules are reduced without substantially deoxygenating the organic reactive molecules. The resulting stream is then conducted to a second stage where deoxygenation takes place.

Applicant's co-pending patent application EP 21152117.4 discloses a process for hydrotreating a liquid oil stream such as pyrolysis oil stream by, in continuous operation, reacting the liquid oil stream with hydrogen in the presence of a nickel-molybdenum (Ni—Mo) based catalyst, thereby forming a stabilized liquid oil stream. The process may further comprise passing the stabilized liquid oil stream through a hydrodeoxygenation (HDO) step.

US 20170253808 discloses a single step catalytic process for the preparation of aromatic rich aviation fuel from renewable resource in the presence of a hydrogen stream, and one or more hydroprocessing catalysts with mixed hot and cold streams of the renewable feed. Two portions of deoxygenated feed, i.a. a cold liquid feed and a hot liquid feed are introduced in different sections of the catalytic reactor for temperature control.

US 20150166473 discloses a process for the production of surfactant compounds from a feed obtained from renewable sources, comprising hydrotreatment of feed in a fixed bed reactor having a plurality of catalytic zones disposed in series. The feed is injected in a staggered manner and injected in increasing proportions in order to produce an effluent containing at least hydrocarbon compounds containing linear paraffins.

US 2008050792 discloses a process for conversion of lignin to liquid products such as bio-fuels and fuel additives. The process comprises a stage of stabilization/partial hydrodeoxygenation (HDO) following by a stage of hydroprocessing comprising exhaustive HDO and mild hydrocracking.

A stabilized liquid oil is still highly reactive, so that it is difficult to control the maximum heat release in downstream steps, particularly for hydrodeoxygenation (HDO) comprising a catalytic bed (fixed bed) after stabilizing the liquid oil. While it would be desirable to operate with a maximum temperature rise across a bed of 50° C. or less, the reactive feed i.e. liquid oil, even after prior stabilization, will tend to show a much higher temperature rise, thereby increasing the outlet temperature of the HDO to which the stabilized liquid oil is fed and thereby causing plugging due to coking.

It is therefore an object of the present invention to be able to control the heat release of reactive liquid feedstocks, in particular liquid oils, such as HTL oils or pyrolysis oils, particularly after their stabilization in a stabilization reactor.

It is another object of the present invention to reduce the need of using recycling streams for controlling the heat release of reactive liquid feedstocks, in particular liquid oils, such as HTL oils or pyrolysis oils, particularly after their stabilization in a stabilization reactor.

These and other objects are solved by the present invention.

Accordingly, there is provided a process for hydrotreating a liquid oil feedstock stream comprising the steps of:

i) conducting the liquid oil feedstock stream to a stabilization step by reacting the liquid oil stream with hydrogen in the presence of a catalyst for producing a stabilized composition, and separating therefrom:
   a stabilized stream comprising a gas phase, and
   a stabilized liquid oil stream;

ii) providing a main hydrodeoxygenation (HDO) step, comprising:
   ii)-1 conducting at least a portion of said stabilized stream comprising a gas phase, or a stabilized feed stream combining at least a portion of said stabilized stream comprising a gas phase and a portion of said stabilized liquid oil stream, to a main hydrodeoxygenation (HDO) step in a first bed active in hydrodeoxygenation (HDO), thereby producing a first main hydrotreated effluent stream;
   ii-2) combining at least a portion of said stabilized liquid oil stream with said first main hydrotreated effluent stream, thereby producing a first mixed stabilized gas-liquid oil stream;
   ii-3) conducting said first mixed stabilized gas-liquid oil stream to a subsequent bed active in HDO, thereby producing a main hydrotreated effluent stream;

wherein step ii-1) comprises: diverting a portion of said stabilized liquid oil stream from step i) and combining it with a first portion of said stabilized stream comprising a gas phase from step i), thus forming a stabilized gas-liquid stream; preheating said stabilized gas-liquid stream and combining it with a second portion of said stabilized stream comprising a gas phase from step i), for forming said stabilized feed stream.

It would be understood that that for the purposes of the present invention, the term "subsequent" means one or several, such as second, or third, or fourth, etc.

In step ii-2), the at least a portion of said stabilized liquid oil stream is suitably another portion of the stabilized liquid oil stream from step i).

It would be understood that that for the purposes of the present invention, the term "suitably" means optionally, i.e. an optional embodiment.

The term "present invention" or "invention", may be used interchangeably with, respectively, the term "present application", or "application".

Thereby, in a simple manner undesired heat release of the stabilized liquid oil is controlled and thus mitigated:

after the stabilization step in which diolefins, carbonyls, partly olefins, are removed, the stabilized composition is separated into a stabilized stream comprising a gas phase; or a stabilized stream comprising a gas phase plus part of stabilized liquid stream, as well as the rest of the stabilized liquid stream. The stabilized stream comprising a gas phase is sent to the main HDO step together with part of the remaining liquid, i.e. the stabilized liquid oil stream is then split and distributed into subsequent beds in said main HDO step to control the heat release and avoid preheating the entire stabilized liquid produced in the stabilization reactor of said stabilization step. Hence, the invention provides a liquid quench in between the catalytic beds of the main HDO step.

The solution to the problem of uncontrolled temperature rise in the main HDO unit (HDO reactor) for conducting the HDO step downstream the stabilization reactor is hereby solved in a much simpler manner than in the prior art, which typically involves adding a recycle stream to a given hydrotreatment reactor (unit), such as the main HDO reactor, for limiting the temperature rise in the catalytic bed therein. The present invention reduces the need of using a recycling stream for mitigating the risk of exothermicity in a bed of the HDO reactor. Alternatives according to the prior art include also splitting the feed to a stabilization reactor, which contrasts the present invention by which the reactor effluent from the stabilization step is split instead. When treating a liquid oil such as pyrolysis oil, we find that it is not advantageous to split the liquid oil feedstock stream, as its stabilization is needed before passing it to the subsequent main HDO step. When splitting the feed to the stabilization reactor, the reactions will take place at low temperature, but when the higher temperatures are reached, all of the liquid oil feed will react, and thus create a very large exotherm. In addition, it is often not desirable to use a recycle, as the portion of downstream product which is recycled may not be miscible with the liquid oil feed.

It would be understood, that the term "hydrotreating" means the reaction of organic compounds in the presence of hydrogen for remove oxygen (deoxygenation, decarboxylation) and/or other heteroatoms. For the purposes of the present application, the term "hydrotreating" includes the stabilization step, purification step and main HDO step.

For the purposes of the present application, the term "hydroprocessing" includes hydrotreating, as well as any other steps which are not said stabilization step, purification step and main HDO step. In particular, "hydroprocessing" includes also hydrodewaxing, hydrocracking, isomerization, or hydrodearomatization.

Hydrodeoxygenation (HDO), hydrodewaxing, hydrocracking, isomerization, hydrodearomatization, are defined farther below.

Suitably, the main HDO step is conducted in one or more beds active in hydrodeoxygenation (HDO), i.e. in a fixed bed comprising a catalyst active in HDO. In the HDO step, any organic nitrogen present in the stabilized liquid oil stream, e.g. pyrolysis oil stream, is removed and a hydrotreated effluent stream is produced, which can be subjected to further treatment and separated into hydrocarbon products boiling in the transportation fuel range, such as diesel, jet fuel and naphtha. The further treatment may include any of: hydrodewaxing, hydrocracking, isomerization, or hydrodearomatization, as is well known in the art of fossil oil refining.

Remaining alcohols and acids or other compounds having carbonyl groups from the stabilization step are converted to paraffins primarily in the main HDO step, per the reaction HDO and DCO pathways:

HDO pathway: $C_{17}H_{34}COOH+3.5\ H_2 \leftrightarrow C_{18}H_{38}+2\ H_2O$

Decarboxylation pathway: $C_{17}H_{34}COOH+0.5\ H_2 \leftrightarrow C_{17}H_{36}+CO_2$ In an embodiment, in step ii-1) said pre-heating of the stabilized gas-liquid stream is conducted by heat exchange with said main hydrotreated effluent stream in a first feed/effluent heat exchanger (hereinafter also referred to as F/E HEX).

Because the stabilized composition is split into gas and liquid phases (fractions), heating can be conducted separately on the gas and liquid. Since the liquid oil stream feedstock is typically highly corrosive and unstable, it is advantageous that the present invention enables preheating in said F/E HEX only the gas of the stabilized gas-liquid, thereby avoiding fouling and preheating the liquid too much. The liquid phase, i.e. the stabilized liquid oil stream, will ultimate reach the reactor inlet temperature, but it will not have seen high wall temperatures and the residence time before it hits the reactor catalyst will be minimized. It would be understood that the reactor here is meant to be a HDO reactor comprising said first and subsequent bed(s) active in HDO. Thereby, part of the stabilized gas phase is bypassed, enabling better temperature control. Furthermore, since the stabilized composition is split into gas phase and liquid phase, the inlet temperature for the bed(s) active in HDO can be easily controlled, as part of the stabilized stream comprising a gas phase can bypass the F/E HEX. This will not be possible with a two-phase setup, in which no part of the stabilized stream comprising a gas phase bypasses the cold F/E HEX.

The thus cooled main hydrotreated effluent stream from the main HDO step after delivering heat in said F/E HEX, optionally after having passed through any of the steps of hydrodewaxing, hydrocracking, isomerization, or hydrodearomatization, is optionally also further cooled and conducted to a separation section, from which at least a gas phase, a hydrocarbon product and a purged water stream are withdrawn. In the separation section, the hydrotreated product from the main HDO or from any of the steps of hydrodewaxing, hydrocracking, isomerization, or hydrodearomatization, i.e. a hydroprocessed product, is suitably conducted to a low pressure separator (cold separator) and/or high pressure (HP) separator, from which a hydrocarbon product stream is withdrawn and directed to a product stripper for separating an overhead fraction. The overhead fraction is suitably directed to an overhead separator from which an off-gas stream, mainly as light hydrocarbons with 1 to 5 carbons, may be withdrawn, as well as an overhead liquid fraction from which a naphtha may be produced. Halogens may also be removed in the overhead fraction. From the product stripper a bottom stream is withdrawn and conducted, optionally together with said overhead liquid fraction, to a fractionation step, e.g. in a fractionation unit such as distillation column. From the overhead fraction of the fractionation unit, the naphtha product may be produced, while from the middle and bottom fractions thereof, jet fuel and diesel, respectively, may be produced, as is well-known in the art.

In an embodiment, the process comprises: recycling to the stabilization step, a portion of said stabilized liquid oil stream, such as the stabilized liquid oil stream separated from the stabilized composition produced in the stabilization step. This is advantageous in instances where the product and feed are not miscible, and which often is the case when operating with HTL oil or pyrolysis oil. The stabilized liquid oil stream from the stabilization reactor, is not fully converted and still having a chemical nature similar to the reactive feed (liquid oil feedstock), thereby making them miscible. The thus diluted feed to the stabilization reactor of the stabilization step is uniform, which is advantageous for the catalytic reactions taking place therein, as well as less susceptible to un-wanted polymerization.

In the scenario where the product and feed are miscible, the recycle is suitably from main hydrotreated effluent stream to inlet of the stabilization reactor or the inlet of the HDO reactor. In another embodiment, there is recycling to the inlet (i.e. combining with the liquid feedstock) of the stabilization reactor a portion of the bottom stream from the product stripper. In another embodiment, there is recycling to the outlet of the stabilization reactor (i.e. combining with the stabilized liquid oil withdrawn therefrom) a portion of the bottom stream from the product stripper.

A number of other recycle streams may be provided, such as: gas recycle from a downstream cold separator to provide hydrogen to the stabilization reactor as well as the main HDO and any subsequent hydroprocessing step(s); and such as a liquid recycle from downstream fractionation unit to the above steps and corresponding units to limit the temperature increase therein.

By the invention, the use of a plurality of beds in the main HDO step is envisaged. Accordingly, it would be understood that the term "subsequent bed active in HDO" means further or additional bed(s) active in HDO. A subsequent bed active in HDO thus produces an additional main hydrotreated effluent stream, which can be a second, or third, or fourth, etc. main hydrotreated effluent stream.

The more the subsequent beds active in HDO, and thus the total number of beds active in HDO, the easier to provide once-through operation in the main HDO, provided that enough splits of the stabilized liquid oil stream are applied. For instance: when operating with three beds, there are two splits of stabilized liquid oil stream, as illustrated in the appended FIGURE; when operating with four beds, there are three splits of stabilized liquid oil stream. The use of a plurality of beds is not only advantageous in terms of reducing the volume of process equipment resulting from applying a recycle, but also where the product from the main HDO, and the liquid oil feedstock stream or a stream from the stabilized composition of the stabilization reactor, are not miscible. Once-through operation in the main HDO means that no recycle of the main hydrotreated effluent stream is conducted.

Accordingly, in an embodiment, the main HDO step is operated in once-through mode, i.e. there is no recycle of the main hydrotreated effluent stream to said step ii).

Lowering or eliminating the recycle in connection with the main HDO results also in a downstream separation section being smaller, and thus less costly in terms of capital and operating expenses. Lowering or eliminating the recycle in connection with the main HDO also means that heat integration in the process is more efficient, since there is no need of preheating and cooling the recycle—which will convey an inherent loss of heat which needs to be made up elsewhere—In a no split—of—stabilized oil stream situation, the additional heat required would probably be supplied as fired heater duty, which conveys a big penalty in this type of process layout treating liquid oil streams from particularly solid renewable feedstocks, since a fired heater is a big unit which is not only costly in terms of capital and operating expenses, but also normally requires the use of $CO_2$ producing gases such as methane.

In an embodiment, the split of stabilized liquid oil to the beds active in HDO, which is defined by the proportion of the flow of said stabilized liquid oil stream sent to any of the beds active in HDO, increases from first bed to subsequent bed, i.e. the proportion of said stabilized liquid sent to the first bed is lower than that sent to a subsequent bed, e.g. a second bed.

The split of the stabilized liquid oil stream is utilized to quench between beds, thereby not only controlling the heat release, but also eliminating the need to heat the stabilized liquid oil stream to the inlet temperature of a subsequent bed, thus saving heat exchanger area and attendant capital and operating costs.

Suitably, the split is 20-40 wt %, such as 25-35 wt % to the first bed active in HDO, and 60-80 wt % such, as 65-75 wt % to a subsequent bed. For instance, the HDO step (step ii) may comprise two beds active in HDO, and the split is 32% to 68%.

The much higher portion of stabilized liquid oil being fed to a subsequent (downstream) bed, enables that the downstream bed can be adapted to have a higher heat capacity by virtue of the presence of additional material in the subsequent bed(s). For instance, the last bed (the one which is most downstream) will have the liquid from upstream beds, and thus for a certain duty the temperature increase will be smaller than e.g. the first bed, and therefore more stabilized liquid can be added to the last bed. In addition, there is a higher dilution effect in the subsequent bed(s), and furthermore, some of the reactive compounds are in the gas phase to the first (upstream) bed. The coking potential will be high if the reactive species have a higher concentration. In this scenario, the highest dilution is in the subsequent, e.g. last bed, and thus the most reactive compound(s) can be added thereto, while still having the same coking potential. Therefore, the temperature control goes along with the coking potential.

In an embodiment, said main HDO step is conducted in at least three (3) beds active in HDO, such as in four (4) beds active in HDO. It has been found that when operating with at least three metal guard beds, in particular four metal guard beds, it is not required to have a recycle, so that once-through operation is possible.

In an embodiment, said first bed active in HDO is also active in removing impurities, i.e. a metal guard bed active in hydrodemetalation (HDM) and/or HDO, for thereby producing said first main hydrotreated effluent stream as a first purified main hydrotreated effluent stream.

In an embodiment, said main HDO step is conducted in a single unit, i.e. in the same reactor. For instance, in a fixed bed reactor comprising a number of beds in which a first (upstream) bed is a metal guard bed active in HDM and/HDO, and a subsequent (downstream) bed comprises a catalyst active in HDO.

A simpler process is thereby achieved, as the purification and main HDO steps are conducted in the same reactor. The corresponding liquid quench (with a portion of the stabilized liquid oil stream) in between the metal guard bed and subsequent bed active in HDO is thereby suitably also conducted within the same reactor. All the beds in the reactor can be operated at substantially the same pressure and in such manner that the beds are in direct fluid communication with a subsequent bed, suitably after being combined with a portion of the stabilized liquid stream. A much more inexpedient construction is thereby possible which i.a. enables significant savings in both capital and operating costs.

The term "metal guard bed active in HDM and/or HDO" is also referred herein simply as "metal guard bed", and means a bed, i.e. a fixed bed, which comprises a material active in HDM and/or HDO, such as catalyst active in HDM and/or HDO, so that apart from for removing e.g. phosphorous (P), iron (Fe), nickel (Ni), or vanadium (V), silicon (Si), halides, or combinations thereof, the material may also be provided with deoxygenation activity. A suitably guard bed for at least removing P and Fe is a porous material comprising alumina, the alumina comprising alpha-alumina, with the porous material comprising one or more metals selected from Co, Mo, Ni, W and combinations thereof, and said porous material having a BET-surface area of 1-110 $m^2/g$, suitably also having a total pore volume of 0.50-0.80 ml/g, as measured by mercury intrusion porosimetry, and a pore size distribution (PSD) with at least 30 vol % of the total pore volume being in pores with a radius ≥400 Å, suitably pores with a radius ≥500 Å, such as pores with a radius up to 5000 Å; as for instance disclosed in Applicant's co-pending patent application PCT/EP2021/068656. Another suitably guard bed is a catalyst comprising molybdenum supported on alumina, i.e. a $Mo/Al_2O_3$ catalyst.

Hydrodemetallation (HDM), as is well known in the art, means a pretreatment, by which free metals are generated and then reacted with e.g. $H_2S$ into metal sulfides. It would be understood, that this is different from e.g. hydrodesulfurization (HDS) in which the heteroatom (S) is removed in gas form.

In an embodiment, the process further comprises conducting said main hydrotreated effluent stream, or a portion thereof, to any of the steps: hydrodewaxing, hydrocracking, isomerization, or hydrodearomatization, for thereby producing a hydroprocessed hydrocarbon product. Suitably, a gas phase is withdrawn from the main hydrotreated effluent stream, e.g. a gas phase containing $NH_3$, $H_2S$, $CO_2$, for protecting the catalyst in the subsequent hydrodewaxing, hydrocracking, isomerization, or hydrodearomatization. Suitably, the HDO step and any of the steps: hydrodewaxing, hydrocracking, or isomerization, or hydrodearomatization, are conducted in a single unit, i.e. in the same reactor, for instance in a fixed bed reactor comprising a number of beds in which a bed comprises a catalyst active in HDO, and a subsequent bed a catalyst active in isomerization or hydrodearomatization.

Suitably, the main HDO step including prior removal of impurities, and any of the steps hydrodewaxing, hydrocracking, isomerization, or hydrodearomatization, are conducted in a single unit. For instance, the steps are conducted in a fixed bed reactor comprising a number of beds in which a first bed is a metal guard bed active in HDM and/or HDO, a subsequent bed comprises a catalyst active in HDO, and a subsequent bed a catalyst active in e.g. isomerization, or hydrodearomatization.

Hence, in an embodiment, the single unit comprises one or more metal guard beds active in HDM and/HDO, one or more beds active in HDO, and one or more beds active in hydrodewaxing, hydrocracking, isomerization, or hydrodearomatization. It would be understood that the term "bed active in HDO" means a bed comprising a catalyst active in HDO. The same way of interpretation applies for e.g. the term "active in hydrodewaxing" etc.

This further simplifies the process and integration of steps, as they all conducted in the same reactor.

The material catalytically active in HDO, typically comprises an active metal (sulfided base metals such as nickel, cobalt, tungsten and/or molybdenum, but possibly also either elemental noble metals such as platinum and/or palladium) and a refractory support (such as alumina, silica or titania, or combinations thereof).

HDO conditions involve a temperature in the interval 250-400° C., a pressure in the interval 30-150 bar, and a liquid hourly space velocity (LHSV) in the interval 0.1-2, optionally together with intermediate cooling by quenching with cold hydrogen, feed or product The material catalytically active in hydrodewaxing typically comprises an active metal (either elemental noble metals such as platinum and/or palladium or sulfided base metals such as nickel, cobalt, tungsten and/or molybdenum), an acidic support (typically a molecular sieve showing high shape selectivity, and having a topology such as MOR, FER, MRE, MWW, AEL, TON and MTT) and a refractory support (such as alumina, silica or titania, or combinations thereof).

Isomerization conditions involve a temperature in the interval 250-400° C., a pressure in the interval 20-100 bar, and a liquid hourly space velocity (LHSV) in the interval 0.5-8.

The material catalytically active in hydrocracking is of similar nature to the material catalytically active in isomerization, and it typically comprises an active metal (either elemental noble metals such as platinum and/or palladium or sulfided base metals such as nickel, cobalt, tungsten and/or molybdenum), an acidic support (typically a molecular sieve showing high cracking activity, and having a topology such as MFI, BEA and FAU) and a refractory support (such as alumina, silica or titania, or combinations thereof). The difference to material catalytically active isomerization is typically the nature of the acidic support, which may be of a different structure (even amorphous silica-alumina) or have a different acidity e.g. due to silica:alumina ratio.

Hydrocracking conditions involve a temperature in the interval 250-400° C., a pressure in the interval 30-150 bar or up to 200 bar, and a liquid hourly space velocity (LHSV) in the interval 0.5-8, optionally together with intermediate cooling by quenching with cold hydrogen, feed or product The material catalytically active in hydrodearomatization (HDA) typically comprises an active metal (typically elemental noble metals such as platinum and/or palladium but possibly also sulfided base metals such as nickel, cobalt, tungsten and/or molybdenum) and a refractory support (such as amorphous silica-alumina, alumina, silica or titania, or combinations thereof).

Hydrodearomatization conditions involve a temperature in the interval 200-350° C., a pressure in the interval 20-100 bar, and a liquid hourly space velocity (LHSV) in the interval 0.5-8.

In an embodiment, the stabilization step is conducted at a temperature of 20-240° C., a pressure of 100-200 barg and a liquid hourly space velocity (LHSV) of 0.1-1.1 $h^{-1}$, and a hydrogen to liquid oil ratio is 1000-6000 NL/L, such as 2000-5000 NL/L, suitably in any of: a fixed bed reactor, a slurry bed reactor, trickle bed reactor, and a fluidized bed reactor, as disclosed in said applicant's co-pending application EP 21152117.4. In a particular embodiment, the stabilization step is conducted in a fixed bed reactor, wherein the catalyst is a supported molybdenum (Ni—Mo) based catalyst having a Ni content of 3-5 wt %, Mo content of 15-25 wt %, and optionally also a P content of 1-3 wt %, based on the total weight of the catalyst, suitably wherein the support is selected from alumina, silica, titania and combinations thereof; optionally in combination with a molecular sieve having topology MFI, BEA or FAU.

It would be understood that the unit "barg" denotes pressure above atmospheric (atmospheric pressure: about 1 bar). The pressure is also referred as "hydrogen pressure".

It would be understood, that the unit NL means "normal" liter, i.e. the amount of gas taken up this volume at 0° C. and 1 atmosphere.

It would be understood, that the temperature range 20-240° C. encompasses the inlet temperature of the liquid oil stream and the outlet temperature of stabilized liquid oil stream. For instance, the inlet temperature can be 20, 40, 60 or 80° C. The process is exothermic thus a raise in temperature of about 100° C. or more occurs. The higher the inlet temperature e.g. 80° C., the easier the ignition of the process to initiate the exotherm. The outlet temperature can for instance be 150 or 200 or 240° C.

More generally, the temperature in a given step or reactor (unit) thereof, here for instance the stabilization step, means the inlet temperature in an adiabatic step, or the reaction temperature in an isothermal step.

The inlet temperature may include the effect of a recycle added thereto as a diluent stream. Hence, suitably, in connection with the embodiment directed to the recycle to the stabilization step of said portion of stabilized liquid oil stream, the thus combined diluent stream and the reactive feed i.e. the liquid oil feedstock stream, is directed to contact the fixed bed catalyst which during operation has a lowest temperature sufficient for initiating exothermal hydrogenation, such as at least 80° C., at least 150° C. or at least 200° C., and a sufficiently low temperature to avoid thermal runaway hydrocracking such as less than 280° C., less than 200° C. or less than 180° C., prior to being combined with the liquid oil feedstock stream.

This enables providing an inlet stream to the stabilization reactor having sufficient temperature for hydrotreatment, while still limiting the maximum temperature. For instance, for pyrolysis oil the inlet temperature would commonly be 80-180° C., for the less reactive pyrolysis oil from catalytic pyrolysis and hydrothermal liquefaction 125-200° C. and for more stable products the inlet temperature may be 200-280° C. The lowest temperature of the catalyst in the fixed bed is typically at the inlet of the reactor.

It would be understood, that the term "topology MFI, BEA or FAU", means a structure as assigned and maintained by the International Zeolite Association Structure Commission in the Atlas of Zeolite Framework Types, which is at http:// www.iza-structure.org/databases/or for instance also as defined in "Atlas of Zeolite Framework Types", by Ch. Baerlocher, L. B. McCusker and D. H. Olson, Sixth Revised Edition 2007.

The above conditions of the stabilization reactor enable not only stabilization of the liquid oil stream is possible thereby avoiding plugging problems, but also stabilization without deactivating the catalyst and without risk of hydrogen starvation. Polymerization and etherification may take place during the stabilization, which increases the viscosity of the resulting product. This is a serious challenge leading to the plugging of pipes between the hydrotreatment unit used for stabilization and the subsequent hydroprocessing reactor, for instance a unit comprising metal guard beds active in HDO or more generally a downstream HDO unit.

Suitably, the stabilization step is conducted in a continuous mode, i.e. there is continuous operation of the stabilization reactor.

The term "continuous mode" or "continuous operation", as is well known in the art, means that the incoming stream of liquid oil during a given production cycle is constant, as also is the stabilized liquid oil stream being withdrawn as the outcoming product. This contrasts a batch operation i.e. discontinuous operation, as is also well known in the art, in which the total amount of liquid oil and catalyst is introduced at the beginning of the process, and the outcoming product is withdrawn after a certain period of time.

By the present invention, a continuous operation process is suitably used, since contrary to a batch operation, there is no dependency on the outcoming product (stabilized liquid oil) being fluid at all times. In a batch operation, the liquid oil could start fluid, then solidify for a period during a first temperature of 150° C. and then become fluid again when heated to the final temperatures of 340-400° C. Furthermore, a batch operation gives only an idea about the initial catalyst activity, thus it can easily overestimate the catalyst activity, which is also crucial for industrial application.

In an embodiment, in the stabilization step, said stabilized composition is separated inside the stabilization reactor into said stabilized gas phase stream and said stabilized liquid oil stream.

Thereby, the separation can be made simple within the stabilization reactor itself by e.g. withdrawing the stabilized gas phase stream immediately downstream the fixed bed of the reactor, while the stabilized liquid oil stream (liquid phase) is simply withdrawn as a bottoms stream. The need for separating the gas and liquid phases outside the stabilization reactor, is thus avoided.

In an embodiment, the process comprises a step of: thermal decomposition of a solid renewable feedstock for producing said liquid oil feedstock stream.

In an embodiment, the liquid oil feedstock stream is a pyrolysis oil stream, suitably a pyrolysis stream withdrawn from the pyrolysis of tires.

In an embodiment the pyrolysis oil stream comprises at least 0.5 mol/kg of one or more of: aldehyde compounds, ketones, alcohols, furfural, as determined by ASTM E3146-20.

As used herein, the term "thermal decomposition" shall for convenience be used broadly for any decomposition process, in which a material is partially decomposed at elevated temperature (typically 250° C. to 800° C. or even 1000° C.), in the presence of substoichiometric amount of oxygen (including no oxygen). The product will typically be a combined liquid and gaseous stream, as well as an amount of solid char. The term shall be construed to include processes known as pyrolysis and hydrothermal liquefaction, both in the presence and absence of a catalyst.

Accordingly, in a particular embodiment, the thermal decomposition is pyrolysis, such as fast pyrolysis, as defined farther below, thereby producing said pyrolysis oil stream.

It would be understood that the thermal decomposition is conducted in a thermal decomposition section. Hence, the pyrolysis is conducted in a pyrolysis section, and the hydrothermal liquefaction is conducted in a hydrothermal liquefaction section.

As used herein, the term "section" means a physical section comprising a unit or combination of units for conducting one or more steps and/or sub-steps.

For the purposes of the present invention, the pyrolysis section generates two main streams, namely a pyrolysis off-gas stream and a pyrolysis oil stream. The pyrolysis section may be in the form of a fluidized bed, transported bed, or circulating fluid bed, as is well known in the art. For instance, the pyrolysis section may comprise a pyrolyser unit (pyrolysis reactor), cyclone(s) to remove particulate solids such as char, and a cooling unit for thereby producing said pyrolysis off-gas stream and said pyrolysis oil stream, i.e. condensed pyrolysis oil. The pyrolysis off-gas stream comprises light hydrocarbons e.g. C1-C4 hydrocarbons, CO and $CO_2$. The pyrolysis oil stream is also referred as bio-oil and is a liquid substance rich in blends of molecules usually consisting of more than two hundred different compounds including aldehydes, ketones and/or other compounds such as furfural having a carbonyl group, resulting from the depolymerisation of products treated in pyrolysis.

For the purposes of the present invention, the pyrolysis is preferably fast pyrolysis, also referred in the art as flash pyrolysis. Fast pyrolysis means the thermal decomposition of a solid renewable feedstock in the absence of oxygen, at temperatures in the range 350-650° C. e.g. about 500° C. and reaction times of 10 seconds or less, such as 5 seconds or less, e.g. about 2 sec. Fast pyrolysis may for instance be conducted by autothermal operation e.g. in a fluidized bed reactor. The latter is also referred as autothermal pyrolysis and is characterized by employing air, optionally with an inert gas or recycle gas, as the fluidizing gas, or by using a mixture of air and inert gas or recycle gas. Thereby, the partial oxidation of pyrolysis compounds being produced in the pyrolysis reactor (autothermal reactor) provides the energy for pyrolysis while at the same time improving heat transfer. For details about autothermal pyrolysis, reference is given to e.g "Heterodoxy in Fast Pyrolysis of Biomass" by Robert Brown: https://dx.doi.org/10.1021/acs.energyfuels.0c03512

It would therefore be understood, that for the purposes of the present invention, the use of autothermal pyrolysis. i.e. autothermal operation, is a particular embodiment for conducting fast pyrolysis.

There are several types of fast pyrolysis where a catalyst is used. Sometimes an acid catalyst is used in the pyrolysis reactor to upgrade the pyrolysis vapors, this technology is called catalytic fast pyrolysis and can both be operated in an in-situ mode (the catalyst is located in the pyrolysis reactor) and an ex-situ mode (the catalyst is placed in a separate reactor). The use of a catalyst conveys the advantage of lowering the activation energy for reactions thereby significantly reducing the required temperature for conducting the pyrolysis. In addition, increased selectivity towards desired pyrolysis oil compounds may be achieved.

In some cases, hydrogen is added to the catalytic pyrolysis which is called reactive catalytic fast pyrolysis. If the catalytic pyrolysis is conducted at a high hydrogen pressure (~>5 barg) it is often called catalytic hydropyrolysis.

In an embodiment, the pyrolysis stage is fast pyrolysis which is conducted without the presence of a catalyst and hydrogen, i.e. the fast pyrolysis stage is not catalytic fast pyrolysis, hydropyrolysis or catalytic hydropyrolysis. This enables a much simpler and in-expensive process.

In an embodiment, said pyrolysis off-gas stream comprises CO, $CO_2$ and light hydrocarbons such as C1-C4, and optionally also $H_2S$.

In an embodiment, the thermal decomposition is hydrothermal liquefaction. Hydrothermal liquefaction means the thermochemical conversion of biomass into liquid fuels by processing in a hot, pressurized water environment for sufficient time to break down the solid biopolymeric structure to mainly liquid components. Typical hydrothermal processing conditions are temperatures in the range of 250-375° C. and operating pressures in the range of 40-220 bar. This technology offers the advantage of operation of a lower temperature, higher energy efficiency and lower tar yield compared to pyrolysis, e.g. fast pyrolysis. For details on hydrothermal liquefaction of biomass, reference is given to e.g. Golakota et al., "A review of hydrothermal liquefaction of biomass", Renewable and Sustainable Energy Reviews, vol. 81, Part 1, January 2018, p. 1378-1392.

In an embodiment, the thermal decomposition further comprises passing said solid renewable feedstock through a solid renewable feedstock preparation section comprising for instance drying for removing water and/or comminution for reduction of particle size. Any water/moisture in the solid renewable feedstock which vaporizes in for instance the pyrolysis section condenses in the pyrolysis oil stream and is thereby carried out in the process, which may be undesirable. Furthermore, the heat used for the vaporization of water withdraws heat which otherwise is necessary for the pyrolysis. By removing water and also providing a smaller particle size in the solid renewable feedstock the thermal efficiency of the pyrolysis section is increased.

In an embodiment, the solid renewable feedstock is a lignocellulosic biomass including: wood products, forestry waste, and agricultural residue. In another embodiment the solid renewable feedstock is municipal waste, in particular the organic portion thereof. For the purposes of the present application, the term "municipal waste" is interchange-able with the term "municipal solid waste" and means a feedstock containing materials of items discarded by the public, such as mixed municipal waste given the waste code 200301 in the European Waste Catalog.

In a particular embodiment, the lignocellulosic biomass is forestry waste and/or agricultural residue and comprises biomass originating from plants including grass such as nature grass (grass originating from natural landscape), wheat e.g. wheat straw, oats, rye, reed grass, bamboo, sugar cane or sugar cane derivatives such as bagasse, maize and other cereals.

Any combinations of the above is also envisaged.

As used herein, the term "lignocellulosic biomass" means a biomass containing, cellulose, hemicellulose and optionally also lignin. The lignin or a significant portion thereof may have been removed, for instance by a prior bleaching step.

In another aspect of the invention, there is also provided a plant (i.e. process plant) for carrying out the process according to any of the above or below embodiments, the plant comprising:

- a stabilization reactor arranged to receive a liquid oil feed stream and withdraw:
  - a stabilized stream comprising a gas phase, and
  - a stabilized liquid oil stream;
- a splitting point arranged to divert a portion of said stabilized liquid oil stream;
- a splitting point arranged to divert a first portion of said stabilized stream comprising a gas phase;
- a mixing point, such as a junction, arranged to combine said portion of said stabilized liquid oil stream with said first portion of said stabilized stream comprising a gas phase, and provide a stabilized gas-liquid stream;
- a pre-heater arranged to preheat said stabilized gas-liquid stream, and provide a preheated stabilized gas-liquid stream;

a mixing point, such as junction, arranged to combine the preheated stabilized gas-liquid stream with a second portion of said stabilized stream comprising a gas phase, and provide a stabilized feed stream;

a main hydrodeoxygenation (HDO) reactor comprising a first bed active in HDO which is arranged to receive:

at least a portion of said stabilized stream comprising a gas phase, or said stabilized feed stream, and withdraw a first main hydrotreated effluent stream;

a mixing point, arranged to combine at least a portion of said stabilized liquid oil stream with said first main hydrotreated effluent stream, and provide a first mixed stabilized gas-liquid oil stream;

a subsequent bed active in HDO arranged downstream said first bed active in HDO, in which said subsequent bed active in HDO is arranged to receive said first mixed stabilized gas-liquid oil stream, and withdraw a main hydrotreated effluent stream.

For the purposes of the present invention, the term "mixing point" may be a unit, such as a mixing unit, or a junction, or a physically delimited zone. For instance, the mixing point may be a zone or a portion of the zone in between successive beds of the main HDO reactor 18, such as a zone or a portion of the zone between first bed active in HDO 18' and subsequent bed active in HDO 18" of main HDO reactor 18 as illustrated in the appended FIGURE.

Any of the embodiments and/or associated benefits of the process of the invention may be used in connection with the plant (another aspect of the invention).

The sole accompanying FIGURE shows a process layout in accordance with an embodiment of the invention.

The sole FIGURE shows a process and plant layout 10 for hydrotreating a reactive feedstock in the form of a liquid oil feedstock stream 1. The feedstock 1 is preheated by steam 17 in heat exchanger 12, suitably with steam produced in the process. The steam ensures that the wall temperature in the heat exchanger is kept low thus avoiding undesired reactions of the feedstock. The thus preheated liquid oil feedstock stream 1' is suitably combined with a recycle stream 11' from downstream separation section to form liquid oil feedstock stream 1" and/or recycle stream 15' from downstream separation section to form liquid oil feedstock stream 1'". This feed is stabilized in a stabilization reactor 14 having a fixed bed 14' and comprising e.g. a supported molybdenum (Ni—Mo) based catalyst, which reduces or removes diolefin, olefin and/or carbonyls present in the feedstock. A stabilized composition results, from which a stabilized stream comprising a gas phase 3 and a stabilized liquid oil stream 5 are separated, suitably inside the stabilization reactor 14 downstream said fixed bed 14'. Part 3' of the stabilized stream comprising a gas phase stream 3 and the stabilized liquid oil stream 5' combine to form a stabilized gas-liquid stream 7 which is sent to a feed/effluent heat exchanger (F/E HEX) 16 for preheating, using main hydrotreated effluent stream 9" as heat exchanging medium. Part 3" of the gas phase stream 3 is bypassed for temperature control. The preheated stabilized gas-liquid stream 7' may be further combined with the bypassed gas phase stream 3". The resulting stabilized feed stream 3'" which thus combines at least a portion 3', 3" of said stabilized stream comprising a gas phase 3 and a portion 5' of said stabilized liquid oil stream 5, is conducted to a main HDO reactor 18 comprising plurality of beds active in HDO (18', 18", 18'"). Hence, according to the embodiment illustrated in the FIGURE, three beds active in HDO are used, where there is liquid quench in between the beds by combining at least a portion 5", 5'" of the stabilized liquid oil stream 5 with a first main hydrotreated effluent stream 9, and at least a portion 5'" of the stabilized liquid oil stream 5 with a subsequent, here a second, main hydrotreated effluent stream 9'. The stabilized liquid stream 5" combines with the first main hydrotreated effluent stream 9 to form a first mixed stabilized gas-liquid oil stream, which is then conducted to the subsequent (here second) bed 18" active in HDO. The stabilized liquid stream 5'" combines with the subsequent (second) main hydrotreated effluent stream 9' to form a subsequent (second) mixed stabilized gas-liquid oil stream, which is then conducted to a subsequent (here third and last) bed 18'" active in HDO. A main hydrotreated effluent stream 9" is produced and cooled in said F/E HEX 16 to form further cooled main hydrotreated effluent stream 9'". The main HDO step in main HDO reactor 18 is operated in once-through mode, as there is no recycle of the main hydrotreated effluent stream to the HDO reactor 18.

The cooled main hydrotreated effluent 9'" is then sent to a separation section, where it is directed to a product stripper 20 for stripping out, via the use of a stripping medium such as hydrogen or steam 23, a recycle stream 15 via air cooler 22 and overhead separator 24, as well as water stream 19 and hydrocarbon fraction 13 from which hydrocarbon products such as naphtha may be produced in a downstream fractionation unit (not shown). A bottom stream 11 is withdrawn from the product stripper 20, from which a recycle stream 11' may be combined with the liquid oil feedstock 1'. A portion 11" of the bottom stream 11 is conducted to the fractionation unit for producing said naphtha as well as jet fuel and diesel. The recycle stream 15, suitably rich in hydrogen, is sent via recycle compressor 26, as recycle stream 15' to the stabilization reactor 14.

The invention claimed is:

1. A process for hydrotreating a liquid oil feedstock stream comprising the steps of:

i) conducting the liquid oil feedstock stream to a stabilization step, the stabilization step comprising reacting the liquid oil feedstock stream with hydrogen in the presence of a catalyst for producing a stabilized composition, and separating therefrom:

a stabilized stream comprising a gas phase, and a stabilized liquid oil stream;

ii) providing a main hydrodeoxygenation (HDO) step, comprising:

ii-1) conducting at least a portion of said stabilized stream comprising a gas phase, or a stabilized feed stream combining at least a portion of said stabilized stream comprising a gas phase and a portion of said stabilized liquid oil stream, to the main hydrodeoxygenation (HDO) step in a first bed active in hydrodeoxygenation (HDO), thereby producing a first main hydrotreated stream;

ii-2) combining at least a portion of said stabilized liquid oil stream with said first main hydrotreated effluent stream, thereby producing a first mixed stabilized gas-liquid oil stream;

ii-3) conducting said first mixed stabilized gas-liquid oil stream to a subsequent bed active in HDO, thereby producing a second main hydrotreated stream;

ii-4) discharging a main hydrotreated effluent stream from the main HDO step, the main hydrotreated effluent stream comprising the second main hydrotread stream or a product thereof;

wherein step ii-1) comprises: diverting a portion of said stabilized liquid oil stream from step i) and combining it with a first portion of said stabilized stream comprising a gas phase from step i), thus forming a stabilized gas-liquid stream; preheating said stabilized gas-liquid stream and combining it with a second portion of said stabilized stream comprising a gas phase from step i), for forming said stabilized feed stream.

2. The process of claim 1, wherein in step ii-1), said preheating of the stabilized gas-liquid stream is conducted by heat exchange with said main hydrotreated effluent stream in a feed/effluent heat exchanger.

3. The process of claim 1, comprising: recycling to the stabilization step, a portion of said stabilized liquid oil stream.

4. The process of claim 1, wherein the main HDO step is operated in once-through mode.

5. The process of claim 1, wherein a split of stabilized liquid oil to the beds active in HDO, which is defined by the proportion of the flow of said stabilized liquid oil stream sent to any of the beds active in HDO, increases from the first bed to the subsequent bed.

6. The process of claim 1, wherein said main HDO step is conducted in at least three beds active in HDO.

7. The process of claim 1, wherein said main HDO step is conducted in four beds active in HDO.

8. The process of claim 1, wherein said first bed active in HDO is active in removing impurities, for thereby producing said first main hydrotreated stream as a first purified main hydrotreated stream.

9. The process of claim 7 wherein said first bed active in HDO is a metal guard bed active in hydrodemetalation (HDM) and/or HDO.

10. The process of claim 1, wherein said main HDO step is conducted in a single unit.

11. The process according to claim 10, wherein the single unit comprises one or more metal guard beds active in HDM and/or HDO, one or more beds active in HDO, and one or more beds comprising a catalyst active in hydrodewaxing, hydrocracking, isomerization, or hydrodearomatization.

12. The process of claim 1, further comprising conducting said main hydrotreated effluent stream, or a portion thereof, to any of the steps: hydrodewaxing, hydrocracking, isomerization, or hydrodearomatization, for thereby producing a hydroprocessed hydrocarbon product.

13. The process of claim 1, wherein the stabilization step is conducted at a temperature of 20-240° C., a pressure of 100-200 barg, a liquid hourly space velocity (LHSV) of 0.1-1.1 $h^{-1}$, and a hydrogen to liquid oil ratio is 1000-6000 NL/L.

14. The process of claim 13, wherein the hydrogen to liquid oil ratio is 2000-5000 NL/L.

15. The process of claim 1 wherein the stabilization step is conducted in any of: a fixed bed reactor, a slurry bed reactor, trickle bed reactor, and a fluidized bed reactor.

16. The process of claim 1, wherein the stabilization step is conducted in a fixed bed reactor, wherein the catalyst is a supported molybdenum (Ni—Mo) based catalyst having a Ni content of 3-5 wt. % and a Mo content of 15-25 wt. % based on the total weight of the catalyst.

17. The process of claim 16, wherein the supported molybdenum based catalyst has a P content of 1-3 wt. % based on the total weight of the catalyst.

18. The process of claim 16, wherein the support is selected from alumina, silica, titania and combinations thereof.

19. The process of claim 16, wherein the catalyst comprises a molecular sieve having topology MFI, BEA or FAU.

20. The process of claim 1, wherein in the stabilization step, said stabilized composition is separated inside the stabilization reactor into the stabilized stream comprising the gas phase and the stabilized liquid oil stream.

21. The process of claim 1, comprising a step of: thermal decomposition of a solid renewable feedstock for producing said liquid oil feedstock stream.

22. The process of claim 21, wherein the thermal decomposition comprises a hydrothermal liquefaction or pyrolysis.

23. A plant for carrying out the process of claim 1, comprising:

- a stabilization reactor arranged to receive a liquid oil feed stream and withdraw:
  - a stabilized stream comprising a gas phase, and
  - a stabilized liquid oil stream;
- a splitting point arranged to divert a portion of said stabilized liquid oil stream;
- a splitting point arranged to divert a first portion of said stabilized stream comprising a gas phase;
- a mixing point arranged to combine said portion of said stabilized liquid oil stream with said first portion of said stabilized stream comprising a gas phase, and provide a stabilized gas-liquid stream;
- a pre-heater arranged to preheat said stabilized gas-liquid stream, and provide a preheated stabilized gas-liquid stream;
- a mixing point arranged to combine the preheated stabilized gas-liquid stream with a second portion of said stabilized stream comprising a gas phase, and provide a stabilized feed stream;
- a main hydrodeoxygenation (HDO) reactor comprising a first bed active in HDO which is arranged to receive:
  - at least a portion of said stabilized stream comprising a gas phase, or
  - said stabilized feed stream,
  - and withdraw a first main hydrotreated stream;
- a mixing point, arranged to combine at least a portion of said stabilized liquid oil stream with said first main hydrotreated stream, and provide a first mixed stabilized gas-liquid oil stream;
- a subsequent bed active in HDO arranged downstream said first bed active in HDO, in which said subsequent bed active in HDO is arranged to receive said first mixed stabilized gas-liquid oil stream, and withdraw a second main hydrotreated stream.

* * * * *